US009531102B2

(12) United States Patent
Chen

(10) Patent No.: US 9,531,102 B2
(45) Date of Patent: Dec. 27, 2016

(54) ELECTRICAL POWER CONNECTOR AND A TERMINAL ASSEMBLY

(71) Applicant: OUPIIN ELECTRONIC (KUNSHAN) CO., LTD, Kunshan, Jiangsu (CN)

(72) Inventor: Hsin Chih Chen, Jiangsu (CN)

(73) Assignee: OUPIIN ELECTRONIC (KUNSHAN) CO., LTD, Kunshan, Jiangsu (CN)

( * ) Notice: Subject to any disclaimer, the term of this patent is extended or adjusted under 35 U.S.C. 154(b) by 0 days.

(21) Appl. No.: 14/945,474

(22) Filed: Nov. 19, 2015

(65) Prior Publication Data

US 2016/0233602 A1 Aug. 11, 2016

(30) Foreign Application Priority Data

Feb. 11, 2015 (CN) ..... 2015 1 0070700
Feb. 11, 2015 (CN) ..... 2015 2 0096382 U

(51) Int. Cl.
*H01R 24/00* (2011.01)
*H01R 33/00* (2006.01)
*H01R 13/42* (2006.01)

(52) U.S. Cl.
CPC ..... *H01R 13/42* (2013.01)

(58) Field of Classification Search
CPC ..... H01R 13/42
USPC ..... 439/660
See application file for complete search history.

(56) References Cited

U.S. PATENT DOCUMENTS 8,968,009 B2 * 3/2015 Chen ..... H01R 12/7088 439/79

* cited by examiner

*Primary Examiner* — Javaid Nasri
(74) *Attorney, Agent, or Firm* — Soroker Agmon Nordman

(57) ABSTRACT

An electrical power connector and a terminal assembly are disclosed. The electrical power connector includes a base and a terminal assembly. The terminal assembly includes two conductive terminals, two reinforcing terminals and at least one detection terminal. L-shaped pressing portions of the two reinforcing terminals together clamp arc protruding parts of the two conductive terminals. Meanwhile, the detection terminal can detect an insertion state of a butt connector to timely determine forming a power loop circuit. The terminal assembly of the present invention has characteristics of high electrical conductivity, high elasticity and high security.

10 Claims, 13 Drawing Sheets

ELECTRICAL POWER CONNECTOR AND A TERMINAL ASSEMBLY

BACKGROUND OF THE INVENTION

1. Field of the Invention

The present invention relates to a connector technology, and more particularly to an electrical power connector with characteristics of high electrical conductivity, high elasticity and high security and to a terminal assembly used in the electrical power connector.

2. Description of the Prior Art

The characteristics of a new electrical power connector on the current market are high rated current and low energy loss. The design of an elastic arm is used in a terminal of the electrical power connector for providing an adequate and reliable contact to fit the deviation of the size or the position. Usually, in order to improve the electrical conductivity of the elastic arm, the elasticity of the elastic arm is reduced. But this is not good for the reliable connection and frequent insertion between the electrical power connector a butt connector. On the contrary, if the elasticity of the elastic arm is greater, the contact force and the electrical conductivity between the electrical power connector and the butt connector become worse, so that the prior electrical power connector can not meet the application of high current.

The prior electrical power connector generally includes only one terminal having an integral structure. This terminal can only act as a positive electrode or a negative electrode of a power supply, so the prior electrical power connector can only be used to transfer an unidirectional current. The application of the prior electrical power connector is limited.

Moreover, because the prior electrical power connector does not have a power detection function, the security thereof is lower and it is not suitable for a large current applications.

Hence, it is needed to provide a new electrical power connector, which has a high security, a wide range of application, a better electrical performance and a reliable connection, and also provide a terminal assembly with high electrical conductivity, high security and high elasticity.

BRIEF SUMMARY OF THE INVENTION

A primary object of the present invention is to provide an electrical power connector, which has a terminal assembly with characteristics of high electrical conductivity, high elasticity and high security for providing a better electrical performance and a long term reliable connection, and the terminal assembly is capable of detecting whether a butt connector is normally inserted and determining to form a power loop circuit.

Another object of the present invention is to provide a terminal assembly, which has characteristics of high electrical conductivity, high elasticity and high security for providing a better electrical performance and a long term reliable connection, and is capable of detecting whether a butt connector is normally inserted and determining to form a power loop circuit.

The other object and the advantage of the present invention may be further understood from the technical features disclosed by the present invention.

To achieve the above object of the present invention, the present invention adopts the following technical solution.

The present invention provides an electrical power connector, which comprises a base and a terminal assembly. The base includes an engaging portion located at the front thereof, a mounting portion located at the rear thereof, an insertion opening formed on the engaging portion, a first and second terminal-receiving passages respectively located on two sides of the insertion opening, communicated with the insertion opening and extending to a rear surface of the mounting portion, and at least one third terminal-receiving passage located under the first or second terminal-receiving passage and communicated with the insertion opening. The terminal assembly includes a first conductive terminal, a second conductive terminal opposite to the first conductive terminal and at least one detection terminal. The first conductive terminal is mounted in the first terminal-receiving passage and includes a first main portion fixed in the mounting portion, a first flexible engaging portion formed by being bent toward the second conductive terminal from a front edge of the first main portion and extending into the insertion opening, and a first mounting end located at a lower edge of the first main portion and extending out of the base. The second conductive terminal is mounted in the second terminal-receiving passage and includes a second main portion fixed in the mounting portion, a second flexible engaging portion formed by being bent toward the first conductive terminal from a front edge of the second main portion and extending into the insertion opening, and a second mounting end located at a lower edge of the second main portion and extending out of the base. The detection terminal is mounted in the third terminal-receiving passage and includes a retaining body fixed in the mounting portion, a detection spring located in front of the retaining body and bent toward the first conductive terminal, and a foot located under the retaining body and extending out of the base.

In one embodiment, the first flexible engaging portion includes two pairs of first elastic pieces, which are spaced upper and lower and extend forward; and each of the first elastic pieces has a first arc contact part protruding into the insertion opening and a first head part extending far away from the second conductive terminal. The second flexible engaging portion includes two pairs of second elastic pieces, which are spaced upper and lower and extend forward; and each of the second elastic pieces has a second arc contact part protruding into the insertion opening and a second head part extending far away from the first conductive terminal. The first and second main portions are arranged in parallel, the first and second head parts constitute a trumpet shape, and the first and second arc contact parts constitute a converged shape and are disposed in a front-rear staggered arrangement; the second arc contact part is located in front of the first arc contact part.

In one embodiment, the terminal assembly further includes a first reinforcing terminal and a second reinforcing terminal. The first reinforcing terminal is attached to an outer side of the first conductive terminal and is mounted in the first terminal-receiving passage together with the first conductive terminal; the first reinforcing terminal has a first pressing portion being bent toward the first conductive terminal and pressing an outer side of the first flexible engaging portion. The second reinforcing terminal is attached to an outer side of the second conductive terminal and is mounted in the second terminal-receiving passage together with the second conductive terminal; the second reinforcing terminal has a second pressing portion being bent toward the second conductive terminal and pressing an outer side of the second flexible engaging portion.

In one embodiment, the second reinforcing terminal further has two flexible fingers protruding toward the first conductive terminal; the two flexible fingers separately pass through two pairs of the second elastic pieces, protrude to an inner side of the second conductive terminal and enter into the insertion opening; and the two flexible fingers are located behind the first and second arc contact parts.

In one embodiment, the first pressing portion of the first reinforcing terminal is an L shape, which includes two L type sheets spaced upper and lower; ends of the two L type sheets separately press the outer side of the corresponding first arc contact parts. The second pressing portion of the second reinforcing terminal is also an L shape, which includes two pairs of L type pressing fingers spaced upper and lower; ends of the two pairs of the L type pressing fingers separately press the outer side of the corresponding second arc contact parts; one of the two flexible fingers is located between one pair of the L type pressing fingers, and the other of the two flexible fingers is located between the other pair of the L type pressing fingers.

In one embodiment, the base disposes an upright separator plate on the mounting portion to space the first terminal-receiving passage and the second terminal-receiving passage; the separator plate forms a recess thereon; the base further disposes two cross beams on the mounting portion; the two cross beams are symmetrically located in the first and second terminal-receiving passages to respectively divide the corresponding first and second terminal-receiving passages into upper and lower parts; each cross beam has a front section, a rear section and two shoulders formed on left and right sides of the rear section; the front section is located in the engaging portion and extends to the front surface of the engaging portion; and the rear section is located in the mounting portion. The first and second conductive terminals straddle the cross beam. The first reinforcing terminal further includes a first upright portion and a U-shaped first latching portion formed by being bent from a rear edge of the first upright portion; the first latching portion surrounds the rear section of the corresponding cross beam; the first pressing portion is formed to be L-shaped by being bent toward the first conductive terminal from a front edge of the first upright portion. The second reinforcing terminal further includes a second upright portion and a U-shaped second latching portion formed by being bent from a rear edge of the second upright portion; the second latching portion surrounds the rear section of the corresponding cross beam; the second pressing portion is formed to be L-shaped by being bent toward the second conductive terminal from a front edge of the second upright portion.

In one embodiment, the terminal assembly includes two detection terminals; and the base disposes two third terminal-receiving passages, which are vertically arranged and used to respectively accept the two detection terminals.

In one embodiment, the terminal assembly includes two detection terminals; the base further disposes at least one fourth terminal-receiving passage, which is opposite to the third terminal-receiving passage and is communicated with the insertion opening; one of the two detection terminals is received in the third terminal-receiving passage; and the other of the two detection terminals is received in the fourth terminal-receiving passage.

In one embodiment, the base disposes a lower plate on the mounting portion; the third terminal-receiving passage is located under the lower plate; the base further disposes a first holding groove and a second holding groove between the lower plate and two side walls of the base; the first holding groove is communicated with the first terminal-receiving passage; the second holding groove is communicated with the second terminal-receiving passage; the base disposes a latching groove on an inner top wall of the third terminal-receiving passage; the base also disposes a first retaining groove and a second retaining groove, which are symmetrically formed on the mounting portion and respectively located on inner side walls of the first and second terminal-receiving passages. The first conductive terminal further includes a first retaining plate, which is perpendicularly bent from an upper edge of the first main portion and is held in the first retaining groove; the first mounting end extends out of the base along the first holding groove. The detection terminal disposes a latching plate, which is located above the retaining body and is inserted into the latching groove of the base.

The present invention also provides a terminal assembly, which is applied to an electrical power connector. The terminal assembly comprises a first conductive terminal, a second conductive terminal being opposite to the first conductive terminal, a first reinforcing terminal being attached to an outer side of the first conductive terminal, a second reinforcing terminal being attached to an outer side of the second conductive terminal, and at least one detection terminal located under the first conductive terminal or the second conductive terminal. The first conductive terminal includes a first main portion, a first flexible engaging portion formed by being bent toward the second conductive terminal from a front edge of the first main portion, and a first mounting end located at a lower edge of the first main portion. The first reinforcing terminal includes a first upright portion attached to the first main portion, an L-shaped first pressing portion being bent from a front edge of the first upright portion and pressing an outer side of the first flexible engaging portion, and a U-shaped first latching portion formed by being bent from a rear edge of the first upright portion. The second conductive terminal includes a second main portion, a second flexible engaging portion formed by being bent toward the first conductive terminal from a front edge of the second main portion, and a second mounting end located at a lower edge of the second main portion. The second reinforcing terminal includes a second upright portion attached to the second main portion, an L-shaped second pressing portion being bent from a front edge of the second upright portion and pressing an outer side of the second flexible engaging portion, and a U-shaped second latching portion formed by being bent from a rear edge of the second upright portion. The detection terminal includes a retaining body, a detection spring located in front of the retaining body and bent toward the first or second conductive terminal, and a foot located under the retaining body.

In comparison with the prior art, the electrical power connector of the present invention employs a terminal assembly, which has characteristics of high electrical conductivity, high elasticity and high security to provide a better electrical performance and a long term reliable connection and be capable of detecting whether a butt connector is normally inserted and determining to form a power loop circuit. Moreover, the terminal assembly can use two kinds of different polarity currents to expand the use range of the electrical power connector.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "top", "bottom", "front", "back", "left", "right", "top", "bottom" etc., are only used with reference to the orientation of the accompanying drawings. Therefore, the used directional terms are intended to illustrate, but not to limit, the present invention.

Figure 1:
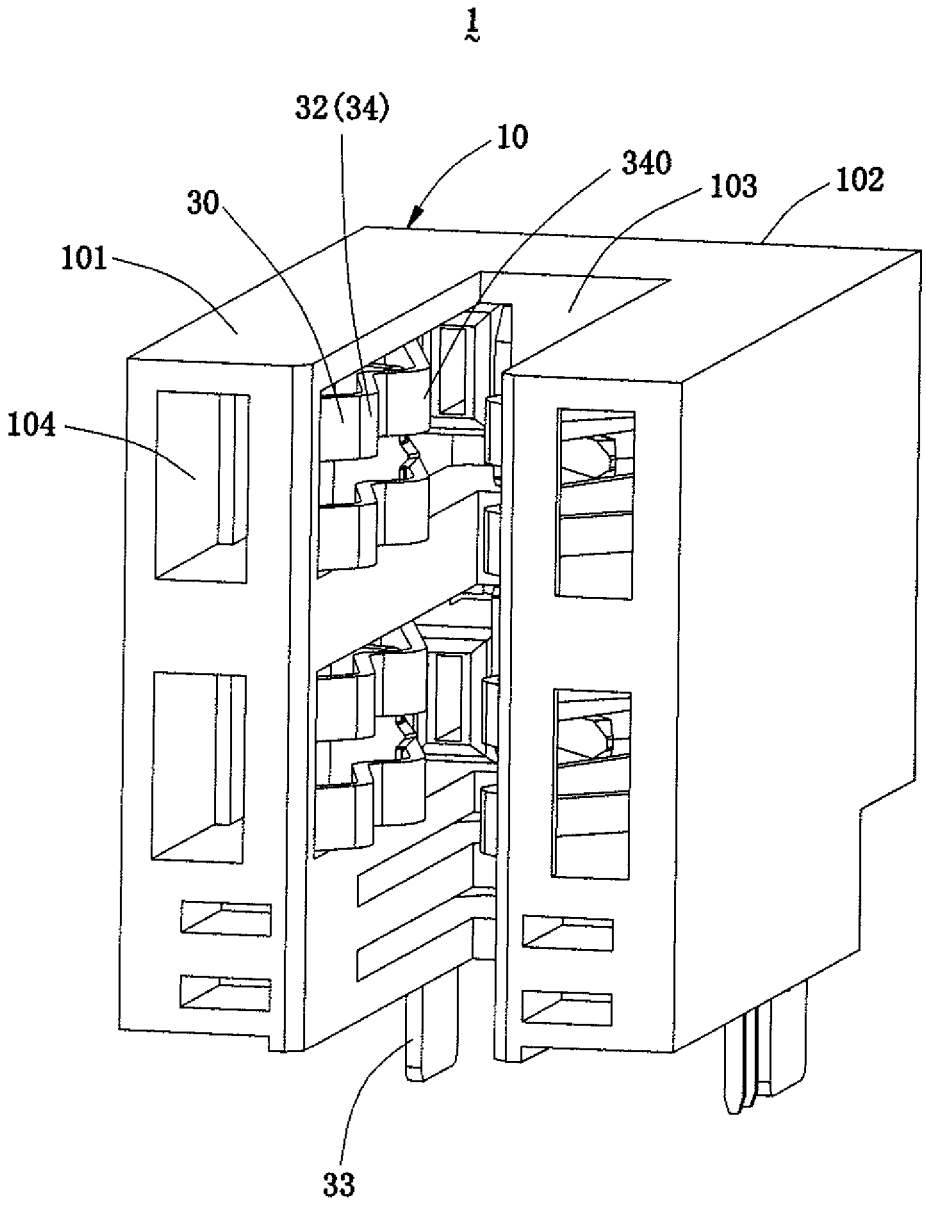
FIG. 1 is a perspective schematic view of an electrical power connector of the present invention.
Figure 2:
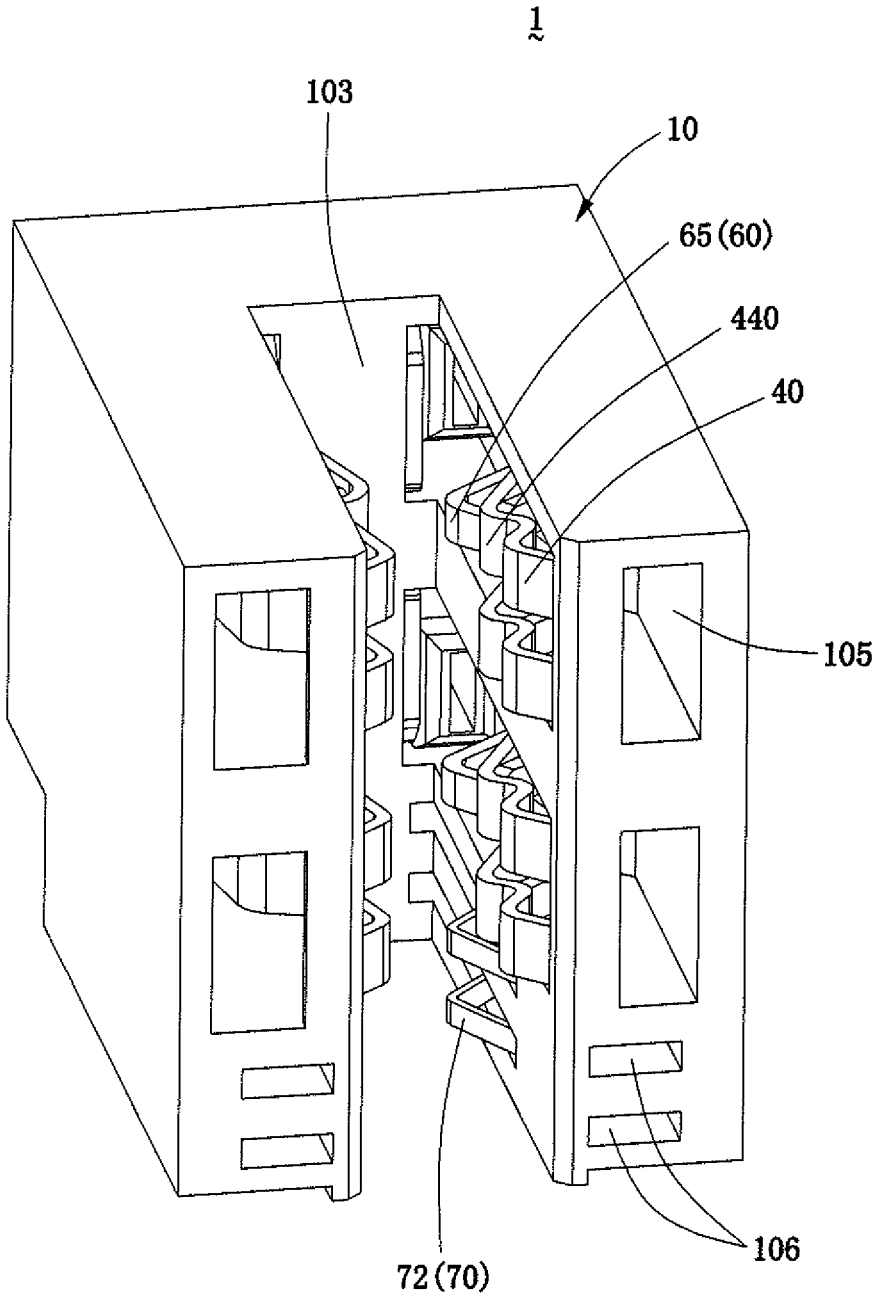
FIG. 2 is a perspective schematic view of the electrical power connector of the present invention in another direction.
Figure 3:
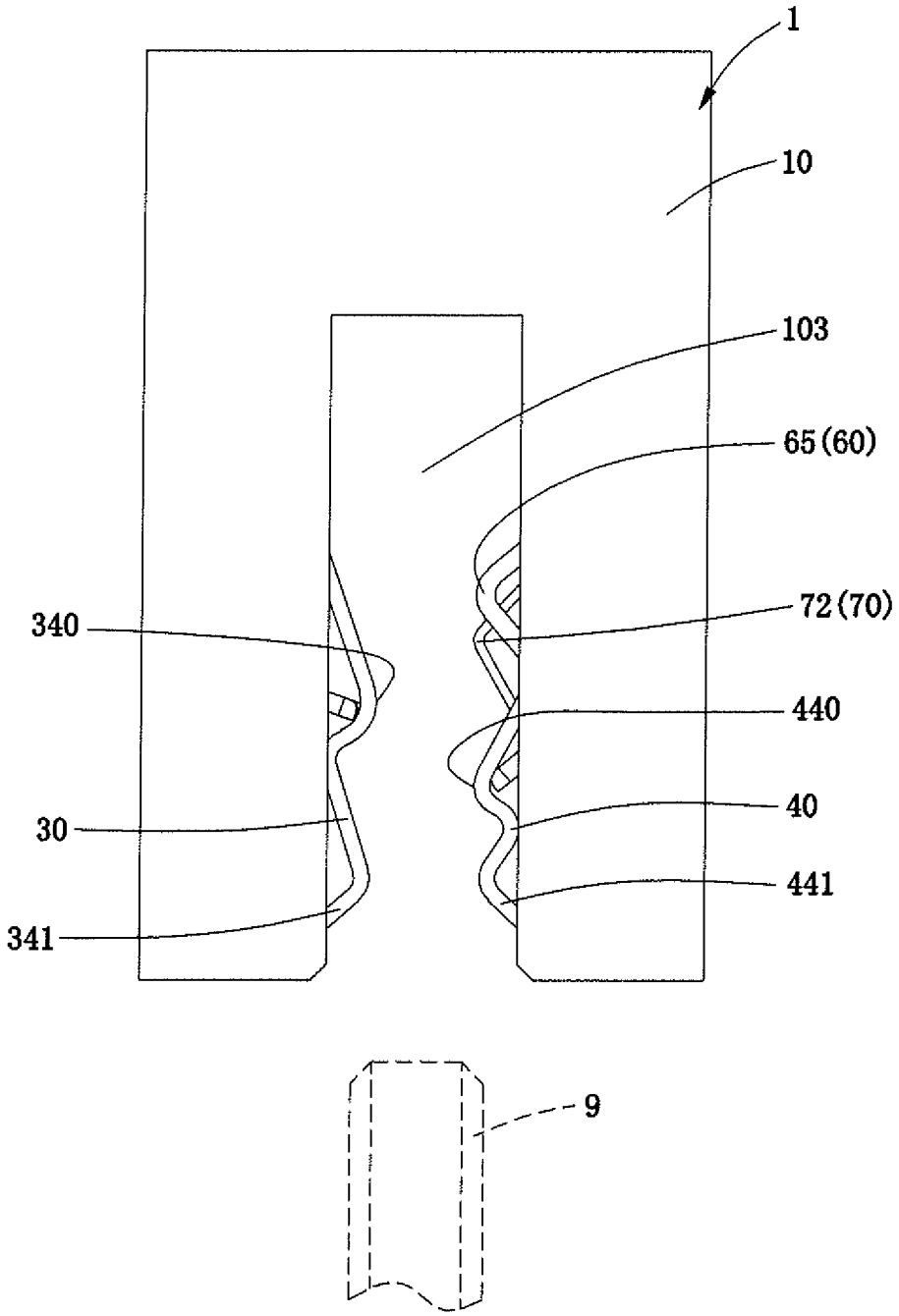
FIG. 3 is a top plan view of the electrical power connector of the present invention, wherein the dotted part indicates a butt connector mated with the electrical power connector.
Figure 4:
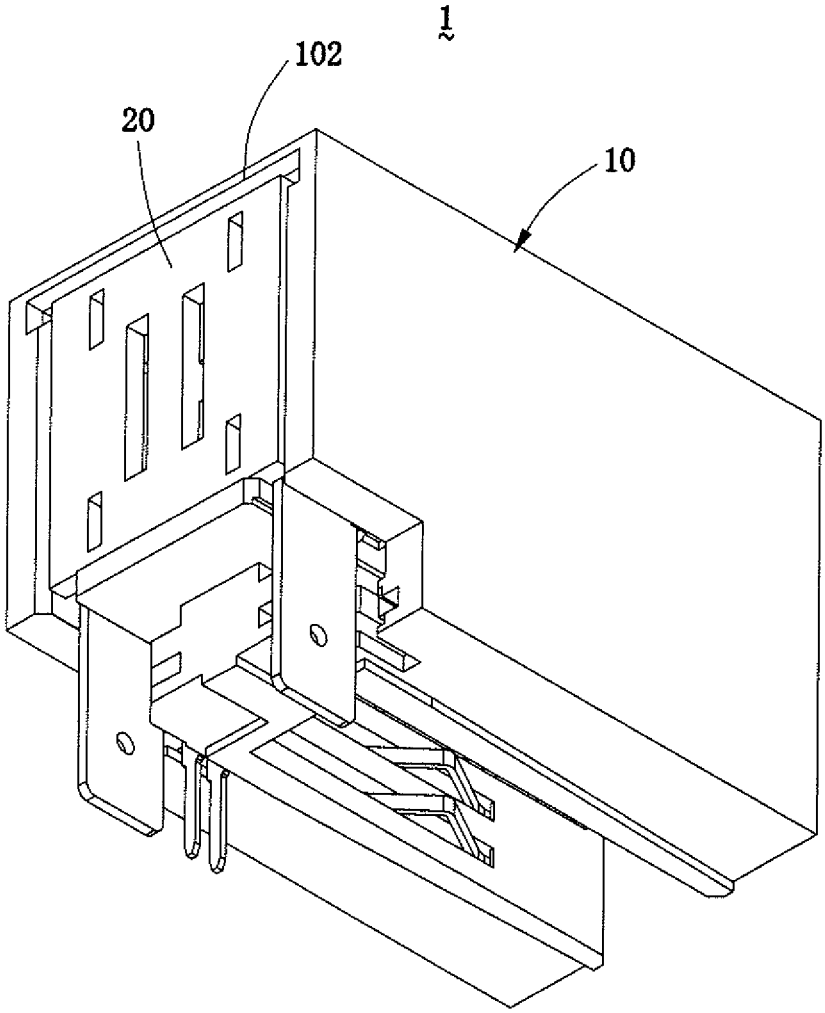
FIG. 4 is a perspective schematic view of the electrical power connector of the present invention in the other one direction.
Figure 5:
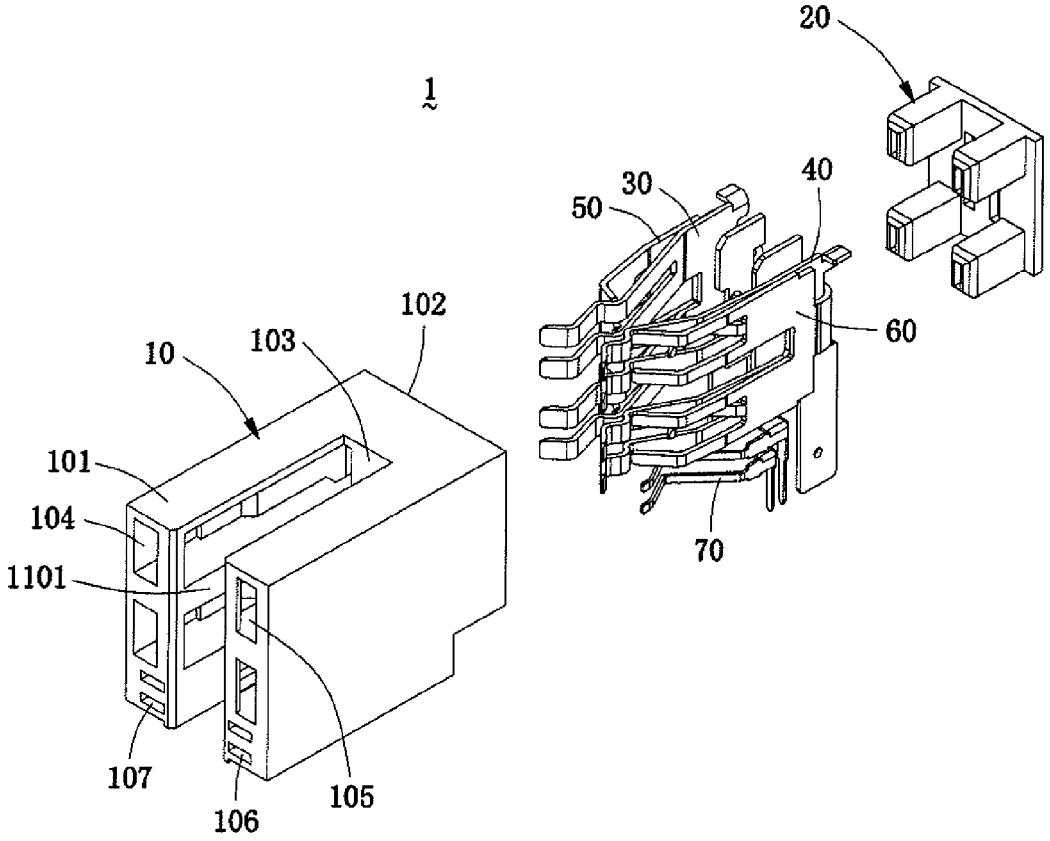
FIG. 5 is an exploded view of the electrical power connector of the present invention.
Figure 6:
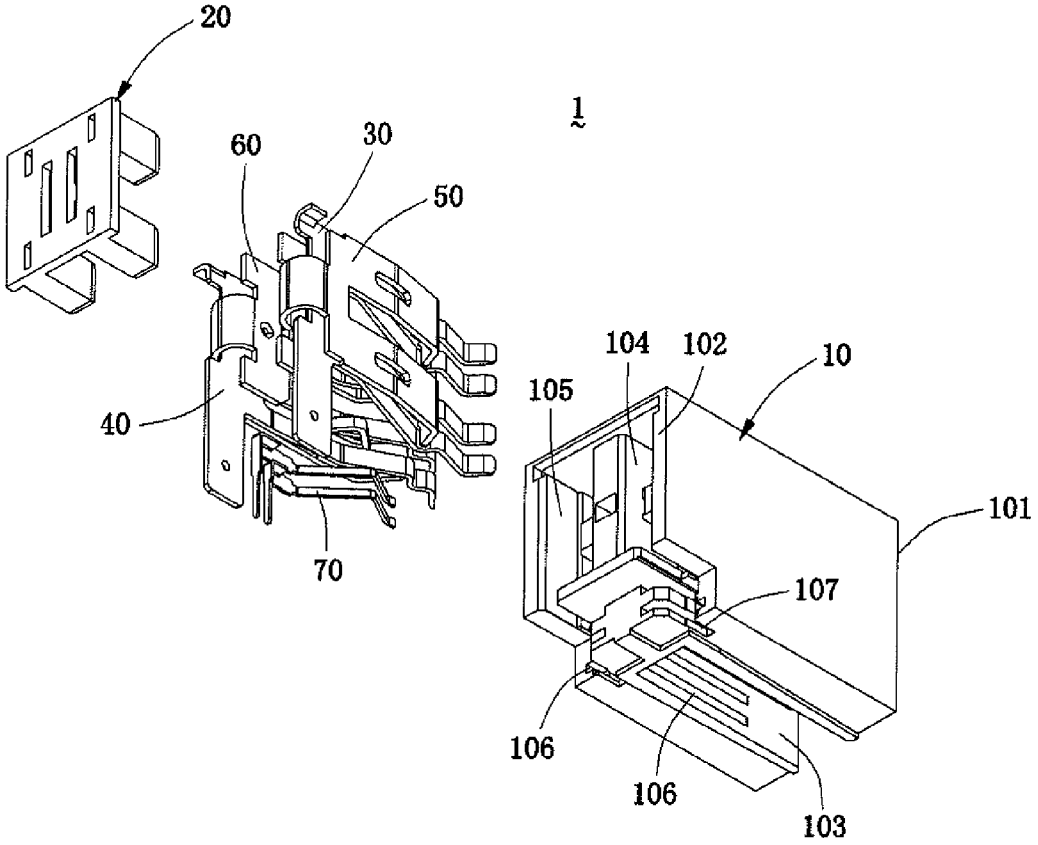
FIG. 6 is an exploded view of the electrical power connector shown by FIG. 4.

Please refer to FIGS. 1 to 6, FIG. 1 is a perspective schematic view of an electrical power connector 1 of the present invention; FIG. 2 is a perspective schematic view of the electrical power connector 1 of the present invention in another direction; FIG. 3 is a top plan view of the electrical power connector 1 of the present invention, wherein the dotted part indicates a butt connector 9 electrically mated with the electrical power connector 1; FIG, 4 is a perspective schematic view of the electrical power connector 1 of the present invention in the other one direction; FIG. 5 is an exploded view of the electrical power connector 1 of the present invention; and FIG. 6 is an exploded view of the electrical power connector 1 in the other one direction.

Please refer to FIGS. 1 to 6, the electrical power connector 1 of the present invention includes a base 10, a terminal assembly mounted on the base 10, and a rear cover mounted on the base 10.

As shown in FIGS. 5 and 6, the base 10 is generally rectangular. The base 10 includes an engaging portion 101 located at the front thereof, a mounting portion 102 located at the rear thereof, an upright insertion opening 103 formed on the engaging portion 101, a first and second terminal-receiving passages 104, 105 respectively located on two sides of the insertion opening 103, communicated with the insertion opening 103 and extending to a rear surface of the mounting portion 102, and at least one third terminal-receiving passage 106 located under the first or second terminal-receiving passage 104 or 105 and communicated with the insertion opening 103. In this embodiment, the first terminal-receiving passage 104 and the second terminal-receiving passage 105 are symmetrically located on the two sides of the insertion opening 103. In this embodiment, the base 10 disposes two third terminal-receiving passages 106, which are vertically arranged and located under the second terminal-receiving passage 105. The base 10 also disposes two fourth terminal-receiving passages 107, which are symmetrical with two third terminal-receiving passages 106 and located under the first terminal-receiving passage 104. All of the terminal-receiving passages 104, 105, 106 and 107 pass through a front surface of the engaging portion 101 and the rear surface of the mounting portion 102. The insertion opening 103 extends rearward from the front surface of the engaging portion 101 and pass through a top surface and a bottom surface of the engaging portion 101.

Figure 7:
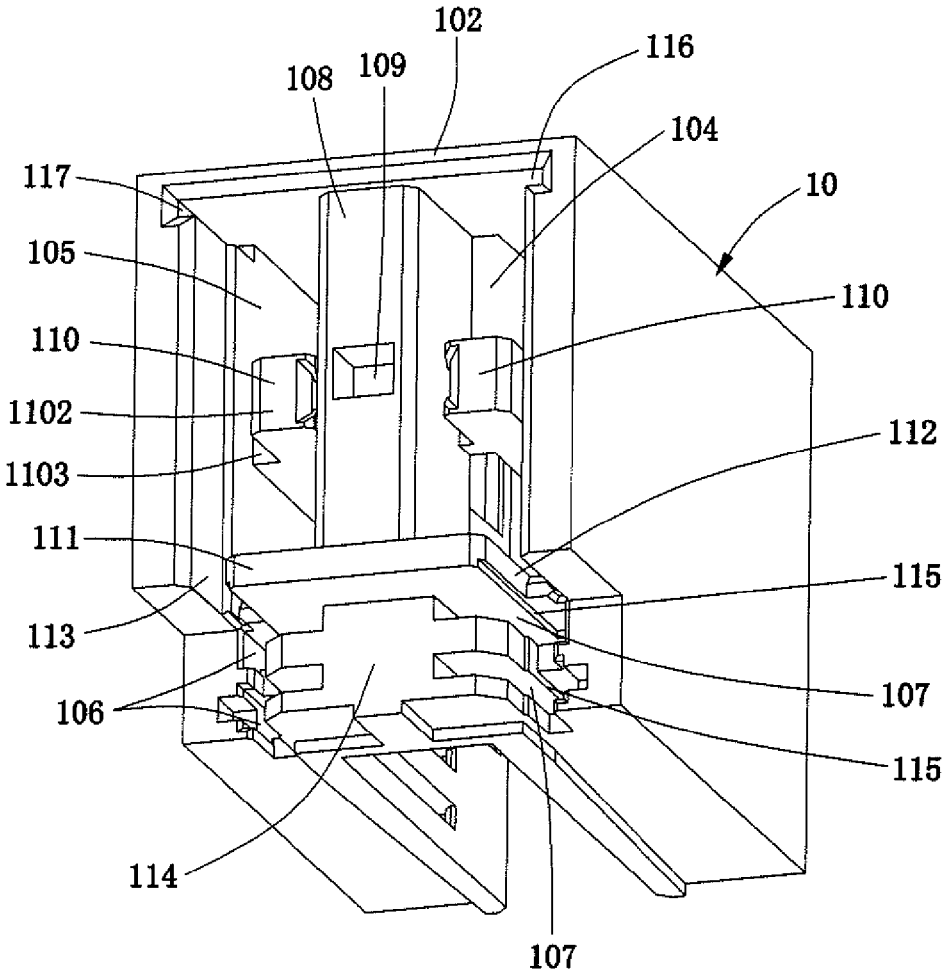
FIG. 7 is a perspective schematic view of a base of the electrical power connector of the present invention.

Please refer to FIG. 7, the base 10 disposes an upright separator plate 108 on the mounting portion 102 to space the first terminal-receiving passage 104 and the second terminal-receiving passage 105. The separator plate 108 forms a recess 109 thereon. The base 10 also disposes two cross beams 110 on the mounting portion 102. The two cross beams 110 are symmetrically located in the first and second terminal-receiving passages 104, 105 to respectively divide the corresponding terminal-receiving passages 104, 105 into upper and lower parts. In this embodiment, each cross beam 110 has a front section 1101 (seen in FIG. 5), a rear section 1102 and two shoulders 1103 formed on left and right sides of the rear section 1102. The front section 1101 is located in the engaging portion 101 and extends to the front surface of the engaging portion 101, and the rear section 1102 is located in the mounting portion 102.

Further, as shown in FIG. 7, the base 10 disposes a lower plate 111 on the mounting portion 102. The lower plate 111 can be used as a bottom of the first and second terminal-receiving passages 104, 105, and the third and fourth terminal-receiving passages 106, 107 are located under the lower plate 111. The base 10 also forms a first holding groove 112 and a second holding groove 113 between the lower plate 111 and two side walls of the base 10. The first holding groove 112 is communicated with the first terminal-receiving passage 104, and the second holding groove 113 is communicated with the second terminal-receiving passage 105. The base 10 further disposes a separator block 114 on the mounting portion 102 to separate the third terminal-receiving passage 106 and the fourth terminal-receiving passage 107. The base 10 disposes latching grooves on inner top walls of the third and fourth terminal-receiving passages 106, 107. FIG. 7 clearly shows one latching groove 115 formed on the inner top wall of the fourth terminal-receiving passage 107, but does not completely show the other latching groove formed on the inner top wall of the third terminal-receiving passage 106 because of a view angle of the drawing.

As shown in FIG. 7, the base 10 also disposes a first retaining groove 116 and a second retaining groove 117, which are symmetrically formed on the mounting portion 102 and respectively located on inner side walls of the first and second terminal-receiving passages 104, 105 and near inner top walls thereof.

Please refer to FIGS, 5 and 6, the terminal assembly includes a first conductive terminal 30, a second conductive terminal 40 opposite to the first conductive terminal 30, a first reinforcing terminal 50 attached to the first conductive terminal 30, a second reinforcing terminal 60 attached to the second conductive terminal 40, and at least one detection terminal 70.

Figure 8:
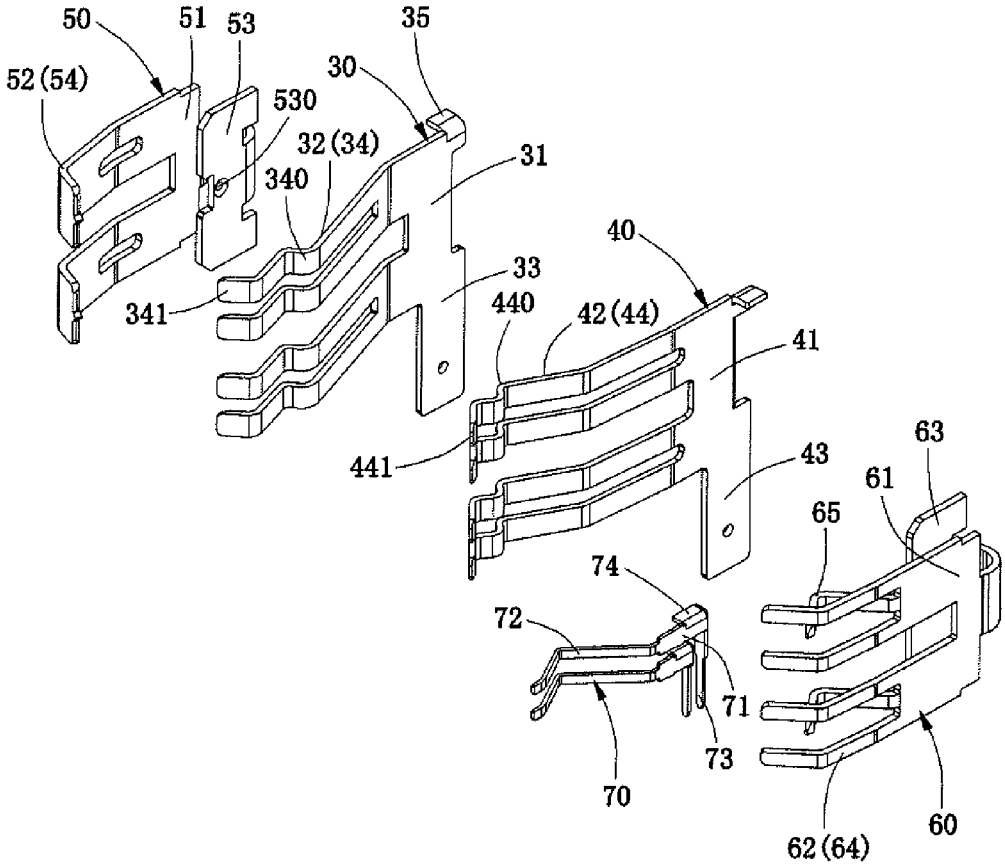
FIG. 8 is a perspective schematic view of a terminal assembly shown in FIG. 5 after disassembling.
Figure 9:
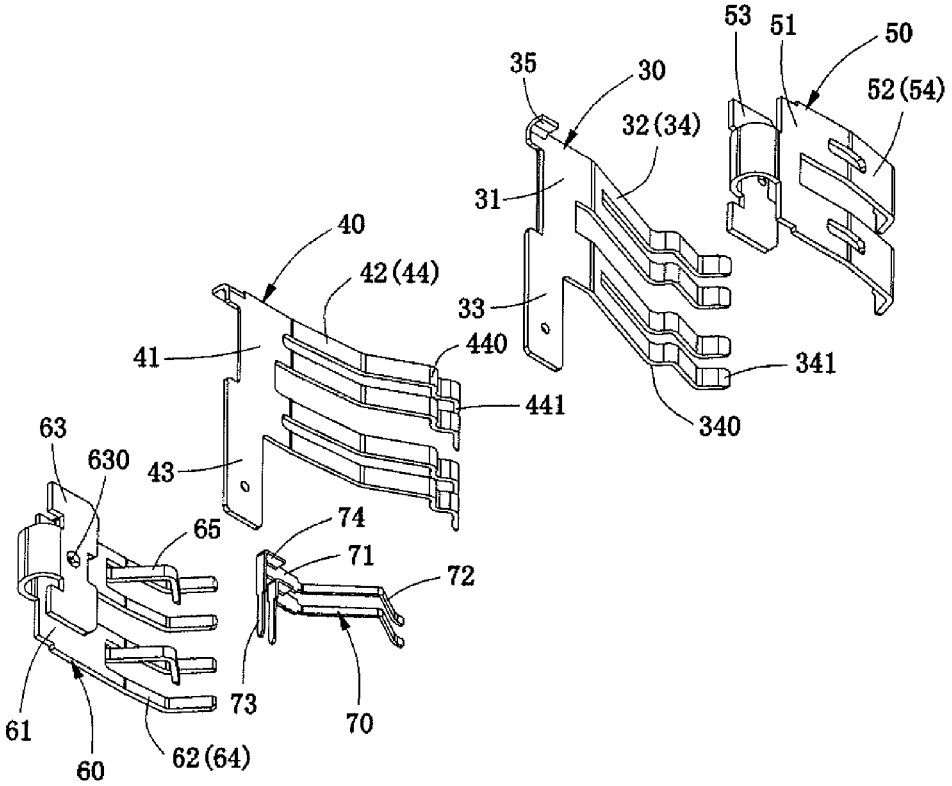
FIG. 9 is a perspective schematic view of the terminal assembly shown in FIG. 6 after disassembling.

Please refer to FIGS. 8 and 9, the first conductive terminal 30 includes a first main portion 31 being plate-shaped, a first flexible engaging portion 32 formed by being bent toward the second conductive terminal 40 from a front edge of the first main portion 31 and extending forward, and a first mounting end 33 located at a lower edge of the first main portion 31. In this embodiment, the first flexible engaging portion 32 includes two pairs of first elastic pieces 34, which are spaced upper and lower and extend forward. Each of the first elastic pieces 34 has a first arc contact part 340 protruding toward the second conductive terminal 40 and a first head part 341 extending far away from the second conductive terminal 40. Moreover, the first conductive terminal 30 further includes a first retaining plate 35, which is perpendicularly bent from an upper edge of the first main portion 31.

Please refer to FIGS. 8 and 9, the first reinforcing terminal 50 includes a first upright portion 51, a first pressing portion 52 formed by being bent toward the first conductive terminal 30 from a front edge of the first upright portion 51, and a first latching portion 53 formed by being bent from a rear edge of the first upright portion 51. In this embodiment, the first latching portion 53 is a U shape, and the first pressing portion 52 is an L shape, which includes two L type sheets 54 spaced upper and lower. Further, the first latching portion 53 forms a first protrusion 530 thereon.

Figure 10:
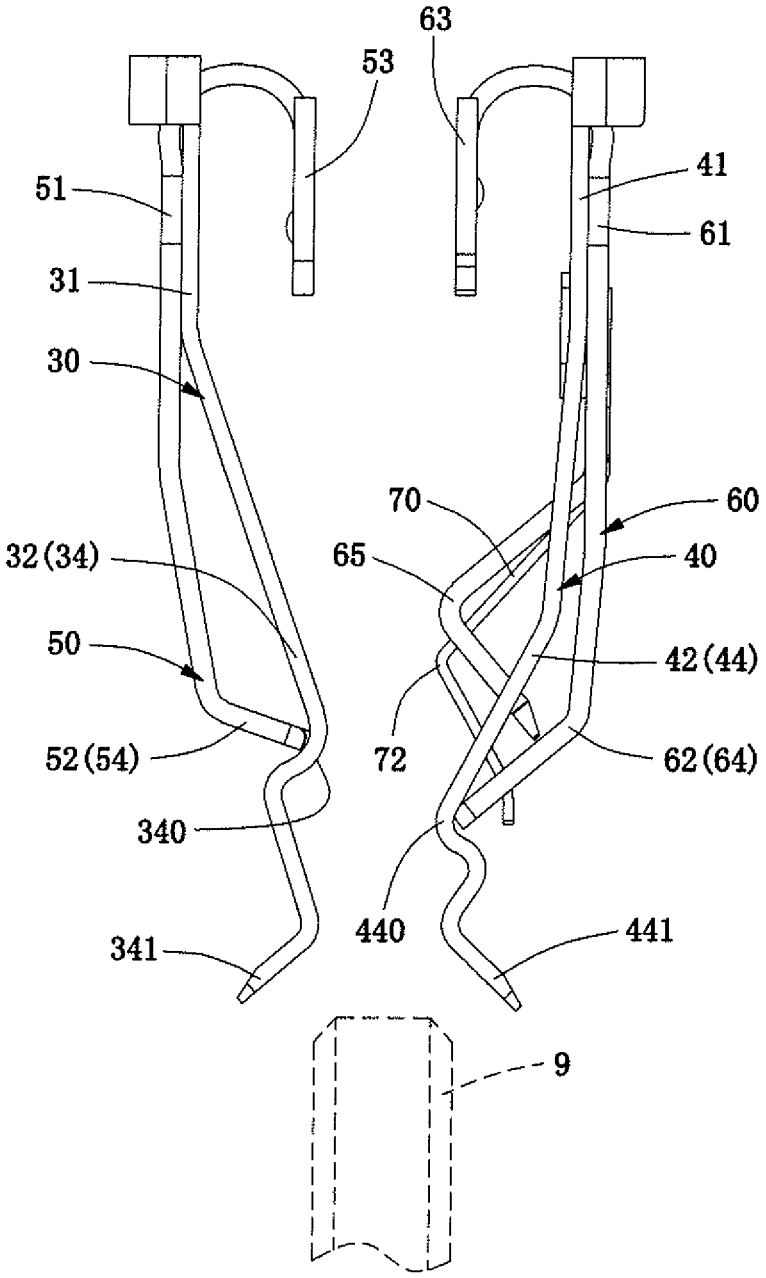
FIG. 10 is a top view of the terminal assembly of the present invention, wherein the dotted part indicates the butt connector mated with the electrical power connector.

As shown in FIG. 10, when the first reinforcing terminal 50 and the first conductive terminal 30 are combined together, the first upright portion 51 is attached to an outer side of the first main portion 31, and the first pressing portion 52 presses an outer side of the first flexible engaging portion 32. Specifically, ends of the two L type sheets 54 separately press outer side of the first arc contact parts 340 of the two pairs of the first flexible engaging portions 32, and the first latching portion 53 goes around to an inner side of the first main portion 31. Wherein the mentioned outer sides mean the side of the first conductive terminal 30, which is far away from the second conductive terminal 40, and the mentioned inner side means the side of the first conductive terminal 30, which is close to the second conductive terminal 40.

Please refer to FIGS. 8 and 9, the structure of the second conductive terminal 40 is similar to that of the first conductive terminal 30. For example, the second conductive terminal 40 includes a second main portion 41 being plate-shaped, a second flexible engaging portion 42 formed by being bent toward the first conductive terminal 30 from a front edge of the second main portion 41 and extending forward, and a second mounting end 43 located at a lower edge of the second main portion 41. In this embodiment, the second flexible engaging portion 42 includes two pairs of second elastic pieces 44, which are spaced upper and lower and extend forward. Each of the second elastic pieces 44 has a second arc contact part 440 protruding toward the first conductive terminal 30 and a second head part 441 extending far away from the first conductive terminal 30. As shown in FIG. 10, the difference between the first and second conductive terminals 30, 40 is that: the second arc contact part 440 and the first arc contact part 340 are disposed in a front-rear staggered arrangement, and the position of the second arc contact part 440 is slightly closer to the front.

Please refer to FIGS. 8 and 9, the second reinforcing terminal 60 includes a second upright portion 61, a second pressing portion 62 formed by being bent toward the second conductive terminal 40 from a front edge of the second upright portion 61, and a second latching portion 63 formed by being bent from a rear edge of the second upright portion 61. In this embodiment, the second latching portion 63 is U-shaped, and the second pressing portion 62 is L-shape. The second pressing portion 62 includes two pairs of L type pressing fingers 64 spaced upper and lower. Further, the second latching portion 63 forms a second protrusion 630 thereon. In this embodiment, the second reinforcing terminal 60 further includes a flexible finger 65 formed between two L type pressing fingers 64 of each one pair and protruding toward the first conductive terminal 30. Namely, the second reinforcing terminal 60 includes two flexible fingers 65, one of which is located between two L type pressing fingers 64 of one pair, and the other of which is located between two L type pressing fingers 64 of the other pair. A bending direction of the flexible finger 65 is opposite to that of the L type pressing finger 64, so the both have different functions.

As shown in FIG. 10, when the second reinforcing terminal 60 and the second conductive terminal 40 are combined together, the second upright portion 61 is attached to an outer side of the second main portion 41, and the second pressing portion 62 presses the outer side of the second flexible engaging portion 42. Specifically, ends of the two pairs of the L type pressing fingers 64 separately press the outer side of the second arc contact parts 440 of the two pairs of the second elastic pieces 44. The two flexible fingers 65 separately pass through two pairs of the corresponding second elastic pieces 44, protrude to an inner side of the second conductive terminal 40 and are located behind the first and second arc contact parts 340, 440, therefore the two flexible fingers 65 and the second arc contact part 440 are arranged in a front-rear direction. The second latching portion 63 goes around to an inner side of the second main portion 41. Wherein the outer side means the side of the second conductive terminal 40, which is far away from the first conductive terminal 30, and the inner side means the side of the second conductive terminal 40, which is close to the first conductive terminal 30.

As shown in FIG. 10, the first and second main portions 31, 41 are arranged in parallel. The first and second head parts 341, 441 together constitute a trumpet shape to be convenient for a smooth insertion of a butt connector 9. The first and second arc contact parts 340, 440 together constitute a converged shape for being electrically connected with the butt connector 9. The first conductive terminal 30 can be used as a positive or a negative, and the second conductive terminal 40 can be correspondingly used as a negative or a positive. The first and second reinforcing terminals 50, 60 can together clamp the first and second conductive terminal 30, 40 to provide a reinforcing function. Moreover, when the butt connector 9 is inserted between the first and second arc contact parts 340, 440, although the first and second arc contact parts 340, 440 are disposed in the front-rear staggered arrangement, the butt connector 9 will not be subjected to a torsion force because the flexible fingers 65 located behind the second arc contact part 440 can eliminate the torsion force to achieve a force balance. Accordingly, the electrical connection between the butt connector 9 and the electrical power connector 1 is more stable.

Please refer to FIGS. 8 and 9, in the embodiment, the terminal assembly includes two detection terminals 70 located under the second conductive terminal 40. Each detection terminal 70 has a retaining body 71, a detection spring 72 located in front of the retaining body 71 and bent toward the first conductive terminal 30, and a foot 73 located under the retaining body 71. The detection terminal 70 also has a latching plate 74 located above the retaining body 71. In other embodiments, the two detection terminals 70 may be arranged under the first conductive terminal 30. As shown in FIG. 10, the detection spring 72 of the detection terminal 70 and the second arc contact part 440 of the second conductive terminal 40 are located on a same side of the first conductive terminal 30 and protrude toward the first conductive terminal 30.

The following text will describe the assembly relationship of the terminal assembly and the base 10.

Figure 11:
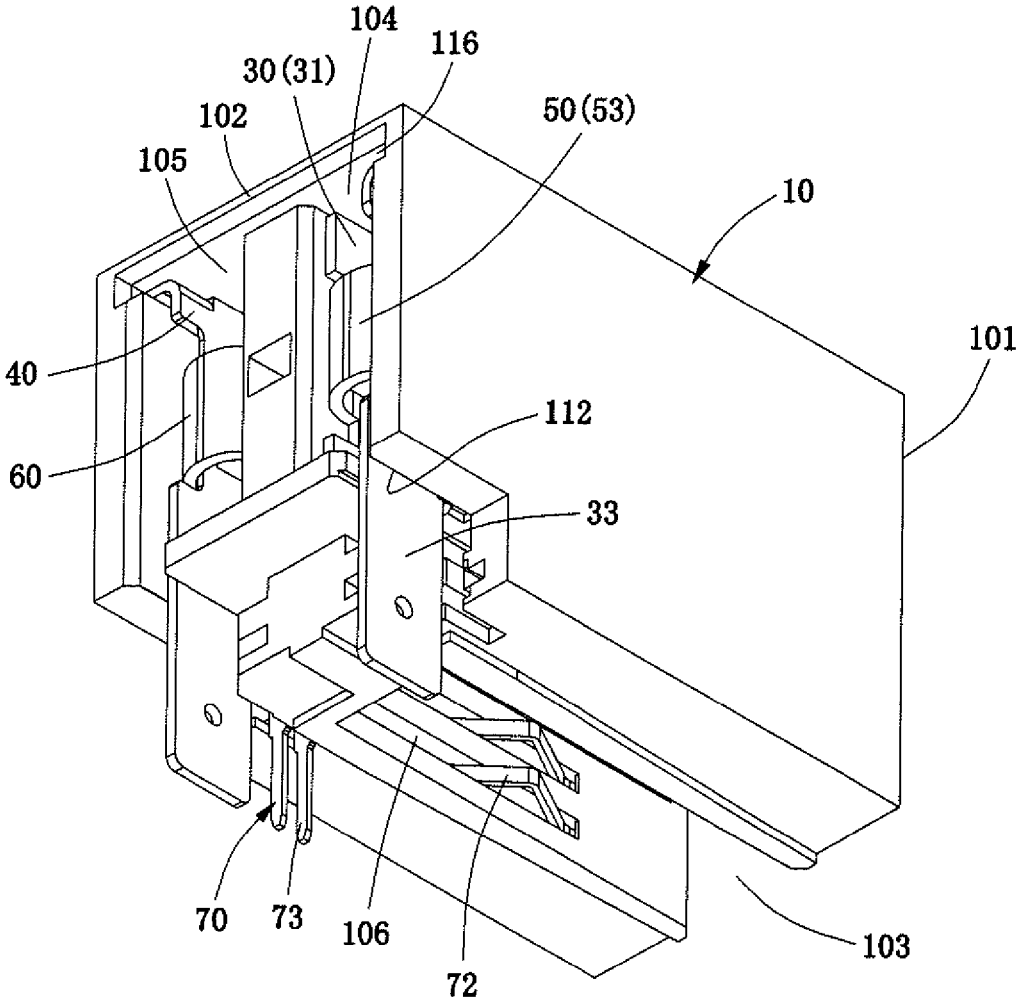
FIG. 11 is a perspective schematic view showing that the terminal assembly is mounted on the base.

Please refer to FIGS. 1 and 11, the first conductive terminal 30 and the first reinforcing terminal 50 are together mounted in the first terminal-receiving passage 104 of the base 10. The first main portion 31 is mounted in the mounting portion 102. The first retaining plate 35 (seen in FIG. 9) is held in the first retaining groove 116. The first flexible engaging portion 32 is inserted into the engaging portion 101 and enters into the insertion opening 103 to be ready for being electrically mated with the butt connector 9 shown in FIG. 3. Specifically, the two pairs of the first elastic pieces 34 of the first conductive terminal 30 separately enter from upper and lower sides of the cross beam 110 (seen in FIG. 7) into the engaging portion 101, and straddle the cross beam 110. The shoulder 1103 (seen in FIG. 7) of the cross beam 110 can ensure the first conductive terminal 30 to be normally inserted into the first terminal-receiving passage 104 and prevent the excessive forward insertion of the first conductive terminal 30. The first arc protruding parts 340 protrude into the insertion opening 103. The first mounting end 33 extends out of the base 10 along the first holding groove 112. Moreover, the first latching portion 53 of the first reinforcing terminal 50 surrounds the rear section 1102 (seen in FIG. 7) of the cross beam 110 to ensure the first reinforcing terminal 50 being closely attached on the first conductive terminal 30.

Similarly, as shown in FIGS. 2 and 11, the second conductive terminal 40 and the second reinforcing terminal 60 are also together mounted into the second terminal-receiving passage 105 of the base 10, according to the above way. The second arc protruding parts 440 of the second conductive terminal 40 and the flexible fingers 65 of the second reinforcing terminal 60 protrude into the insertion opening 103 to be ready for being electrically mated with the butt connector 9 shown in FIG. 3.

Please refer to FIGS. 2 and 11, the two detection terminals 70 are separately mounted in the corresponding third terminal-receiving passages 106. The detection spring 72 protrudes into the insertion opening 103 to be ready for being electrically mated with the butt connector 9 shown in FIG. 3. The latching plate 74 (seen in FIG. 9) is inserted into the latching groove 115 (seen in FIG. 7) of the base 10. The foot 73 extends out of the base 10.

Moreover, the protection scope of the present invention can not be limited by the above assembly location of the two detection terminals 70. For example, in other embodiments, the two detection terminals 70 may be located under the first conductive terminal 30 and be mounted in the two fourth terminal-receiving passages 107, which are upper and lower stacked. Of course, it is possible to mount one detection terminal 70 into one of the third terminal-receiving passages 106, and mount the other detection terminal 70 into one of the fourth terminal-receiving passages 107. Furthermore, the two detection terminals 70 may be separately mounted into the third and fourth terminal-receiving passages 106, 107 in a symmetrical manner or in an asymmetrical manner. Namely, the two detection terminals 70 may be arranged in an upper and lower stacked way, or in a left and right symmetrical way, or in an upper-lower and left-right asymmetrical way according to the actual need.

Figure 12:
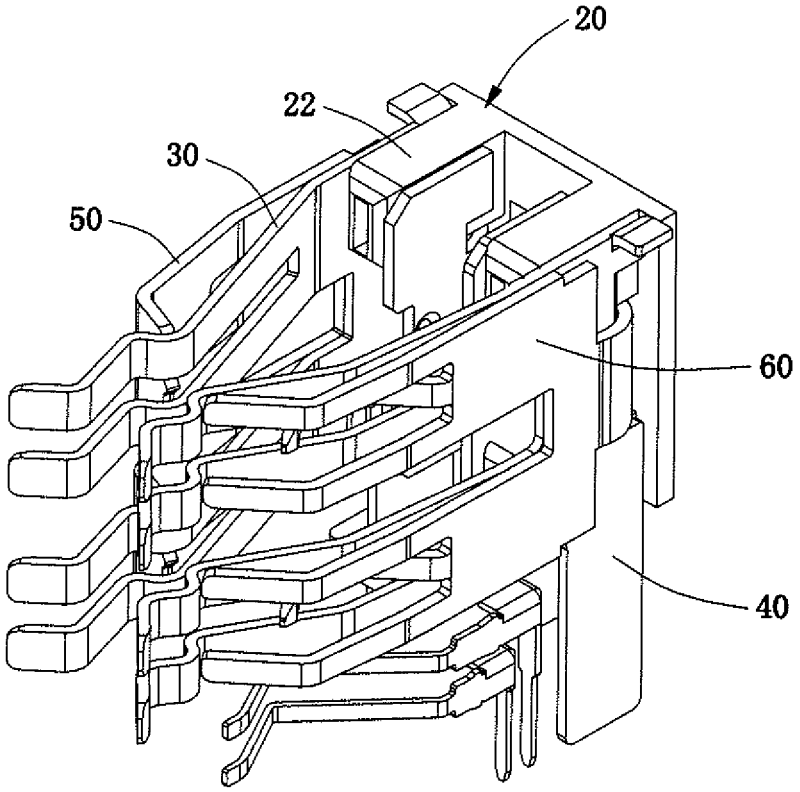
FIG. 12 is a schematic view showing a position relation of the terminal assembly and a rear cover.
Figure 13:
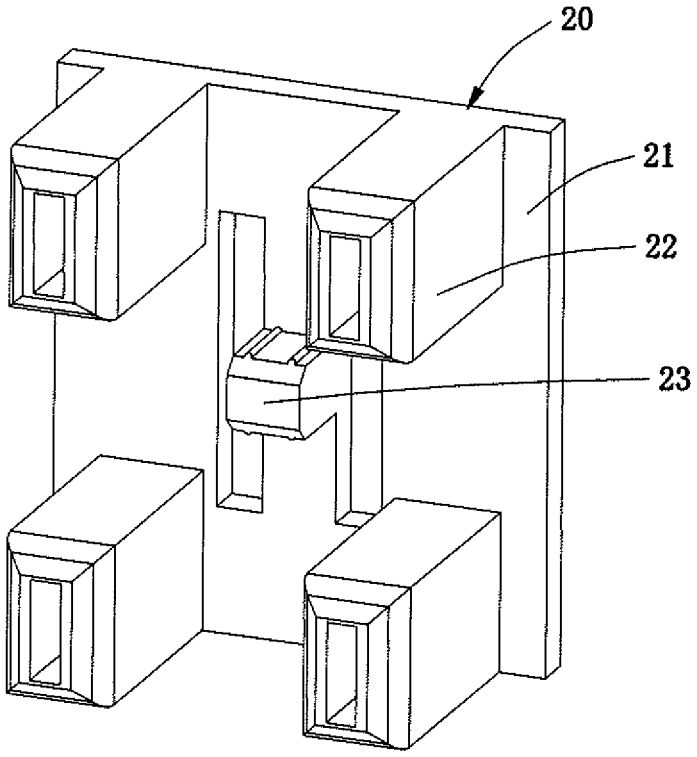
FIG. 13 is a structural schematic view of the rear cover of the electrical power connector of the present invention.

Please refer to FIG. 13, the rear cover 20 includes a rear plate 21, four insertion columns 22 symmetrically formed on the rear plate 21, and a locking block 23 located on the middle of the rear plate 21. As shown in FIGS. 4 and 12, the rear cover 20 is mounted on the mounting portion 102 of the base 10, the four insertion columns 22 are inserted into the terminal assembly, and the locking block 23 (seen in FIG. 13) is inserted into the recess 109 (seen in FIG. 7) of the base 10 and fixed therein. In detail, as shown in FIG. 12, the two insertion columns 22 are inserted into a space defined by the first conductive terminal 30 and the first reinforcing terminal 50, and the other two insertion columns 22 are inserted into a space defined by the second conductive terminal 40 and the second reinforcing terminal 60.

Please refer to FIG. 3, when the butt connector 9 needs to be electrically connected to the electrical power connector 1, first the butt connector 9 is gradually inserted into the insertion opening 103 along the first head part 341 and the second head part 441, then one electrode located on one side of the butt connector 9 is the first to electrically contact with the second arc contact part 440 of the second conductive terminal 40, and next the other electrode located on the other side of the butt connector 9 electrically contacts with the first arc contact part 340 of the first conductive terminal 30. With the continue insertion of the butt connector 9, the butt connector 9 will be electrically mated with the detection spring 72 of the detection terminal 70 and the flexible fingers 65 of the second reinforcing terminal 60.

As described above, the electrical power connector 1 of the present invention employs at least one detection terminal 70, which can detect an insertion state of the butt connector 9 and timely form a power loop circuit. Meanwhile, the terminal assembly of the present invention has characteristics of high electrical conductivity, high elasticity and high security for providing a better electrical performance and a long term reliable connection, and being capable of detecting whether the butt connector 9 is normally inserted. Moreover, the terminal assembly of the present invention can use two kinds of different polarity currents to expand the use range of the electrical power connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical power connector, comprising:

a base, which includes an engaging portion located at the front thereof, a mounting portion located at the rear thereof, an insertion opening formed on the engaging portion, a first and second terminal-receiving passages respectively located on two sides of the insertion opening, communicated with the insertion opening and extending to a rear surface of the mounting portion, and at least one third terminal-receiving passage located under the first or second terminal-receiving passage and communicated with the insertion opening; and a terminal assembly, which includes a first conductive terminal, a second conductive terminal opposite to the first conductive terminal and at least one detection terminal;

wherein the first conductive terminal is mounted in the first terminal-receiving passage and includes a first main portion fixed in the mounting portion, a first flexible engaging portion formed by being bent toward the second conductive terminal from a front edge of the first main portion and extending into the insertion opening, and a first mounting end located at a lower edge of the first main portion and extending out of the base;

the second conductive terminal being mounted in the second terminal-receiving passage and including a second main portion fixed in the mounting portion, a second flexible engaging portion formed by being bent toward the first conductive terminal from a front edge of the second main portion and extending into the insertion opening, and a second mounting end located at a lower edge of the second main portion and extending out of the base; and the detection terminal being mounted in the third terminal-receiving passage and including a retaining body fixed in the mounting portion, a detection spring located in front of the retaining body and bent toward the first conductive terminal, and a foot located under the retaining body and extending out of the base.

2. The electrical power connector as claimed in claim 1, wherein the first flexible engaging portion includes two pairs of first elastic pieces, which are spaced upper and lower and extend forward; and each of the first elastic pieces has a first arc contact part protruding into the insertion opening and a first head part extending far away from the second conductive terminal;

the second flexible engaging portion includes two pairs of second elastic pieces, which are spaced upper and lower and extend forward; and each of the second elastic pieces has a second arc contact part protruding into the insertion opening and a second head part extending far away from the first conductive terminal; and the first and second main portions are arranged in parallel, the first and second head parts constitute a trumpet shape, and the first and second arc contact parts constitute a converged shape and are disposed in a front-rear staggered arrangement; the second arc contact part is located in front of the first arc contact part.

3. The electrical power connector as claimed in claim 2, wherein the terminal assembly further includes a first reinforcing terminal and a second reinforcing terminal;

the first reinforcing terminal is attached to an outer side of the first conductive terminal and is mounted in the first terminal-receiving passage together with the first conductive terminal; the first reinforcing terminal has a first pressing portion being bent toward the first conductive terminal and pressing an outer side of the first flexible engaging portion; and the second reinforcing terminal is attached to an outer side of the second conductive terminal and is mounted in the second terminal-receiving passage together with the second conductive terminal; the second reinforcing terminal has a second pressing portion being bent toward the second conductive terminal and pressing an outer side of the second flexible engaging portion.

4. The electrical power connector as claimed in claim 3, wherein the second reinforcing terminal further has two flexible fingers protruding toward the first conductive terminal; the two flexible fingers separately pass through two pairs of the second elastic pieces, protrude to an inner side of the second conductive terminal and enter into the insertion opening; and the two flexible fingers are located behind the first and second arc contact parts.

5. The electrical power connector as claimed in claim 4, wherein the first pressing portion of the first reinforcing terminal is an L shape, which includes two L type sheets spaced upper and lower; ends of the two L type sheets separately press the outer side of the corresponding first arc contact parts; and the second pressing portion of the second reinforcing terminal is also an L shape, which includes two pairs of L type pressing fingers spaced upper and lower; ends of the two pairs of the L type pressing fingers separately press the outer side of the corresponding second arc contact parts; one of the two flexible fingers is located between one pair of the L type pressing fingers, and the other of the two flexible fingers is located between the other pair of the L type pressing fingers.

6. The electrical power connector as claimed in claim 5, wherein the base disposes an upright separator plate on the mounting portion to space the first terminal-receiving passage and the second terminal-receiving passage; the separator plate forms a recess thereon; the base further disposes two cross beams on the mounting portion; the two cross beams are symmetrically located in the first and second terminal-receiving passages to respectively divide the corresponding first and second terminal-receiving passages into upper and lower parts; each cross beam has a front section, a rear section and two shoulders formed on left and right sides of the rear section; the front section is located in the engaging portion and extends to the front surface of the engaging portion; and the rear section is located in the mounting portion;

the first and second conductive terminals straddle the cross beam;

the first reinforcing terminal further includes a first upright portion and a U-shaped first latching portion formed by being bent from a rear edge of the first upright portion; the first latching portion surrounds the rear section of the corresponding cross beam; the first pressing portion is formed to be L-shaped by being bent toward the first conductive terminal from a front edge of the first upright portion; and the second reinforcing terminal further includes a second upright portion and a U-shaped second latching portion formed by being bent from a rear edge of the second upright portion; the second latching portion surrounds the rear section of the corresponding cross beam; the second pressing portion is formed to be L-shaped by being bent toward the second conductive terminal from a front edge of the second upright portion.

7. The electrical power connector as claimed in claim 1, wherein the terminal assembly includes two detection terminals; and the base disposes two third terminal-receiving passages, which are vertically arranged and used to respectively accept the two detection terminals.

8. The electrical power connector as claimed in claim 1, wherein the terminal assembly includes two detection terminals; the base further disposes at least one fourth terminal-receiving passage, which is opposite to the third terminal-receiving passage and is communicated with the insertion opening; one of the two detection terminals is received in the third terminal-receiving passage; and the other of the two detection terminals is received in the fourth terminal-receiving passage.

9. The electrical power connector as claimed in claim 1, wherein the base disposes a lower plate on the mounting portion; the third terminal-receiving passage is located under the lower plate; the base further disposes a first holding groove and a second holding groove between the lower plate and two side walls of the base; the first holding groove is communicated with the first terminal-receiving passage; the second holding groove is communicated with the second terminal-receiving passage; the base disposes a latching groove on an inner top wall of the third terminal-receiving passage; the base also disposes a first retaining groove and a second retaining groove, which are symmetrically formed on the mounting portion and respectively located on inner side walls of the first and second terminal-receiving passages;

the first conductive terminal further includes a first retaining plate, which is perpendicularly bent from an upper edge of the first main portion and is held in the first retaining groove; the first mounting end extends out of the base along the first holding groove; and the detection terminal disposes a latching plate, which is located above the retaining body and is inserted into the latching groove of the base.

10. A terminal assembly, which is applied to an electrical power connector, comprising a first conductive terminal, a second conductive terminal being opposite to the first conductive terminal, a first reinforcing terminal being attached to an outer side of the first conductive terminal, a second reinforcing terminal being attached to an outer side of the second conductive terminal, and at least one detection terminal located under the first conductive terminal or the second conductive terminal;

wherein the first conductive terminal includes a first main portion, a first flexible engaging portion formed by being bent toward the second conductive terminal from a front edge of the first main portion, and a first mounting end located at a lower edge of the first main portion;

the first reinforcing terminal including a first upright portion attached to the first main portion, an L-shaped first pressing portion being bent from a front edge of the first upright portion and pressing an outer side of the first flexible engaging portion, and a U-shaped first latching portion formed by being bent from a rear edge of the first upright portion;

the second conductive terminal including a second main portion, a second flexible engaging portion formed by being bent toward the first conductive terminal from a front edge of the second main portion, and a second mounting end located at a lower edge of the second main portion;

the second reinforcing terminal including a second upright portion attached to the second main portion, an L-shaped second pressing portion being bent from a front edge of the second upright portion and pressing an outer side of the second flexible engaging portion, and a U-shaped second latching portion formed by being bent from a rear edge of the second upright portion; and the detection terminal including a retaining body, a detection spring located in front of the retaining body and bent toward the first or second conductive terminal, and a foot located under the retaining body.

* * * * *